US005630232A

United States Patent [19]

Miller et al.

[11] Patent Number: 5,630,232

[45] Date of Patent: May 20, 1997

[54] NETHER GARMENT HAVING A FLY FRONT AND METHOD OF MAKING SAME

[75] Inventors: Robert A. Miller, New Ringgold; George Banavage, McAdoo, both of Pa.

[73] Assignee: J.E. Morgan Knitting Mills, Inc., Tamaqua, Pa.

[21] Appl. No.: 545,784

[22] PCT Filed: Dec. 22, 1994

[86] PCT No.: PCT/US94/14792

§ 371 Date: Nov. 13, 1995

§ 102(e) Date: Nov. 13, 1995

[87] PCT Pub. No.: WO95/17106

PCT Pub. Date: Jun. 29, 1995

Related U.S. Application Data

[63] Continuation-in-part of Ser. No. 16,756, Dec. 23, 1993, abandoned.

[51] Int. Cl.[6] ..... A41B 9/02

[52] U.S. Cl. ..... 2/404; 2/234; 2/78.1; 2/70; 2/405

[58] Field of Search ..... 2/227, 228, 79, 2/400, 403, 404, 405, 238, 70–73, 75, 78.1–78.4, 234

[56] References Cited

U.S. PATENT DOCUMENTS

| | | |
|---|---|---|
| D. 86,976 | 5/1932 | Raymond . |
| D. 115,983 | 8/1939 | Bailey . |
| 1,180,181 | 4/1916 | Oathout . |
| 2,010,393 | 8/1935 | Hailey . |
| 2,062,161 | 11/1936 | Chatfield . |
| 2,176,790 | 10/1939 | Coppel et al. . |
| 2,249,198 | 7/1941 | Carter . |
| 2,435,377 | 2/1948 | Wise . |
| 2,652,053 | 9/1953 | Dann . |
| 2,739,314 | 3/1956 | Friedman . |
| 2,753,567 | 7/1956 | Brice . |
| 3,111,680 | 11/1963 | Horowitz . |
| 3,487,833 | 1/1970 | Senser . |
| 4,736,468 | 4/1988 | Efird et al. . |

FOREIGN PATENT DOCUMENTS

| | | |
|---|---|---|
| 802243 | 2/1951 | Germany . |

OTHER PUBLICATIONS

Sears Roebuck & Co., F/W–1965; p. 257—Item #3 Thermal Underwear, Upper left of page, (Located in Group 2900 Library).

*Primary Examiner*—C. D. Crowder
*Assistant Examiner*—Gloria Hale
*Attorney, Agent, or Firm*—Dann, Dorfman, Herrell and Skillman; Henry H. Skillman

[57] ABSTRACT

Drawers or briefs made from a knitted tube flattened to provide a front panel and a rear panel with a top waist opening and a pair of bottom leg openings. The front panel has a linear fly opening having a pair of fabric fly flaps coextensive in length with the fly opening. The flaps overlap each other and the front panel on the interior of the garment at one side of the fly opening, providing a triple layer of fabric along the full length of the fly opening. The layers are sewn together by two lines of stitching extending along the tops and bottoms of said flaps, leaving a free edge on each flap remote from said fly opening. The flaps form a transversely open tunnel extending from the fly opening to the free edges of said flaps, and a pocket closed at the fly opening. The method of fashioning the fly opening entails applying a patch to the outside of the knitted tube, cutting through the patch and the tube to form the fly opening and two flaps, and then simultaneously sewing the flaps to the tube along the length of the opening. The flaps are everted through the fly opening and then are sewn to the interior side of the tube to fashion the fly assembly.

20 Claims, 2 Drawing Sheets

NETHER GARMENT HAVING A FLY FRONT AND METHOD OF MAKING SAME

RELATED APPLICATION

The present application is a continuation in part of U.S. application Ser. No. 29/016,756, filed Dec. 23, 1993, now abandoned.

FIELD OF THE INVENTION

The present invention relates to nether garments and is particularly applicable to tubular knit undergarments.

BACKGROUND OF THE INVENTION

Men's underwear generally takes the form of long drawers or shorts. Shorts may be either boxer type which are normally cut from woven fabric and sewn to the desired configuration, and briefs which are generally made from knitted fabric so as to be form-fitting. Briefs may be either cut from flat fabric and sewn together to form the desired configuration or formed from knitted tubular fabric. Drawers are normally formed from knitted tubular fabric.

Men's underwear requires the presence of a fly front and fly fronts have traditionally been fabricated by making the garment in multiple pieces and assembling the pieces so as to provide the desired fly construction. Prior attempts to avoid the cutting and sewing operations have produced fly fronts which tend to gap open or which have presented difficulties in providing access through the fly front for urinating and the like.

SUMMARY OF THE PRESENT INVENTION

The present invention provides a novel fly construction for a nether garment which permits the nether garment to be fabricated from a single length of tubular knit fabric with the simple addition of fly flaps which are sewn to the tubular knit fabric on either side of a longitudinal slit forming the fly opening. The knitted tube is cut and shaped to provide leg openings which are completed by a conventional crotch seam and leg bands and is finished with a waist band in the conventional fashion.

The fly front of the present invention provides a neat appearance and an arrangement which does not unduly inhibit access through the fly opening.

The fly construction of the present invention is fabricated in a simple, yet effective, procedure, enabling eliminating of the expensive and time-consuming operations normally used for fashioning fly fronts.

More specifically, the present invention provides a fly front consisting of a slit in the tubular fabric, a pair of fly flaps co-extensive in length with the slit and secured, one to each edge of the slit opening, the fly flaps being anchored to the body of the garment by being sewn along their opposite ends to each other and to the body fabric at one side of the fly opening, thereby providing a laterally open tunnel between the flaps which affords access through the garment.

The fly construction of the present invention can be produced with a minimum of fabric handling steps.

The present invention enables the fly front to be produced by simply overlaying the fly area of a knitted tube with a patch of fabric which will be cut to form the fabric flaps of the fly assembly. The fabric patch is separated into two parts concurrently with the formation of a fly opening in the knitted tube and the two parts form the flaps which are sewn along the edges of the fly opening in the part of the tube which becomes the front panel of the garment. The patch is formed into separate flaps and the fly opening is formed in the front panel, and the flaps are connected to the edges of the fly opening. The flaps are then everted to the underside of the front panel through the fly opening and are sewn to the underside of the front panel on the same side of the fly opening to produce the novel fly assembly.

BRIEF DESCRIPTION OF THE DRAWINGS

All of the objects of the invention are more fully set forth hereinafter with reference to the accompanying drawing, wherein:

FIG. 6 is a view of the outside of the fabric tube with a fly patch superimposed thereon;

FIG. 7 is a similar view of the outside of the fabric tube after the fly opening and fly flaps are formed;

FIG. 8 is a similar view of the outside of the fabric after the fly flaps are everted to the underside of the tube;

FIG. 9 is a view of the underside of the front panel of the tube shown in FIG. 8;

FIG. 10 is a view of the underside of the front panel with the flaps positioned in overlying relationship and sewn in place; and FIG. 11 is a view of the outside of the garment completed with the waistband in place.

DESCRIPTION OF THE PREFERRED EMBODIMENTS

Figure 1:
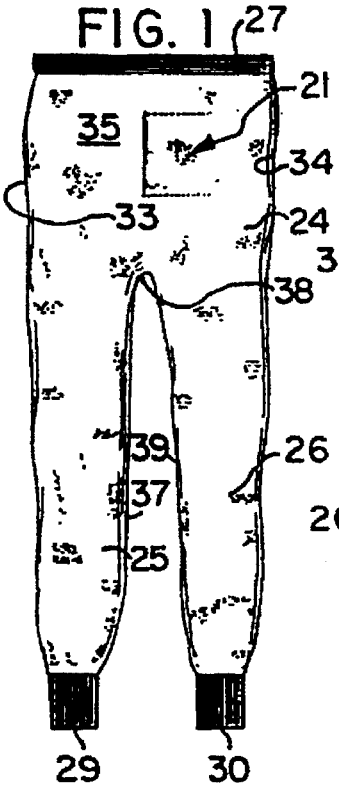
FIG. 1 is a front view of drawers embodying a fly assembly in accordance with the present invention.
Figure 2:
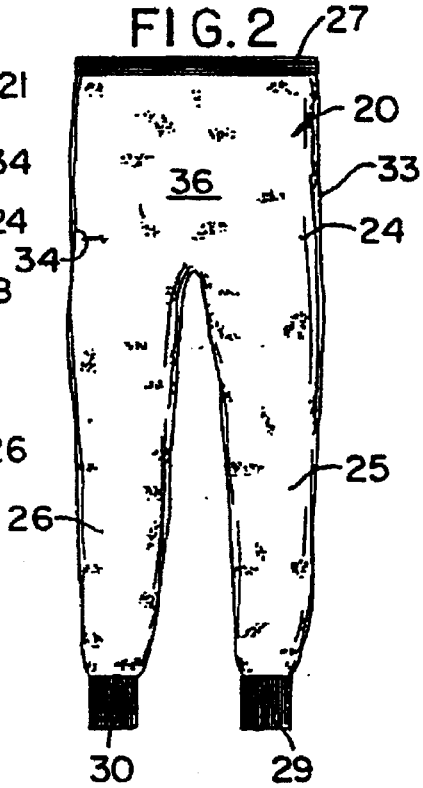
FIG. 2 is a rear view of the drawers shown in FIG. 1.

FIGS. 1 and 2 illustrate a drawers 20 embodying a fly front assembly 21 embodying the invention. The fly front 21 is in the body portion 24 of the garment, and the garment has leg extensions 25 and 26 depending downwardly from the body portion 24. A waistband 27 is at the top of the garment and ankle cuffs 29 and 30 are at the bottom. The drawers 20 are fabricated from a knitted tube which is flattened to provide side fold lines 33 and 34. The fly assembly 21 is positioned in the middle of the front panel 35 which extends between the fold lines 33 and 34 from the waistband 27 to the cuffs 29 and 30 as a continuous expanse which is uninterrupted except for the fly assembly 21. In FIG. 2, a rear panel 36 is shown which extends between the fold lines 33 and 34 and is uninterrupted from the waistband 27 to the cuffs 29 and 30. The outer sides of the legs 25 and 26 are defined by the fold lines 33 and 34, and the inner sides of the legs are defined by an inseam part 37 connecting the front and back panels of the leg extension 25, a crotch seam part 38 connecting the front and back panels 35 and 36 of the trunk portion 24 between the leg extensions, and a further inseam part 39 extending from the crotch seam 38 to the cuff 30 of the leg extension 26. Apart from the fly assembly 21, the drawers 20 are of conventional tubular knit construction.

Figure 5:
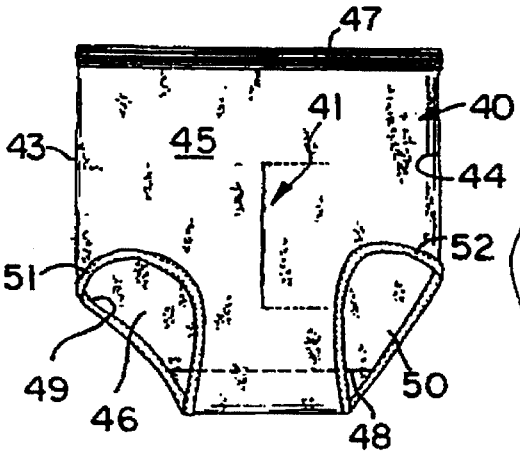
FIG. 5 is a front view of a brief embodying a fly assembly in accordance with the present invention.

A brief 40 embodying the present invention is illustrated in FIG. 5. The brief 40 is likewise knit from a continuous knitted tube, and has a front panel 45 extending between fold lines 43 and 44 and from the waistband 47 to a crotch seam 48. A rear panel 46 likewise extends from the waistband 47 between the fold lines 43 and 44 to the crotch seam 48. Leg openings 49 and 50 are cut into the front and rear panels, and in the present instance are bound with leg bands 51 and 52 respectively. As seen in FIG. 5, the front panel 45 provides an expanse from the waistband 47 to the leg bands 51 and 52 and the crotch seam 48 which is uninterrupted except for a fly assembly 41 centered in the front panel. The rear panel of the brief 40 provides an uninterrupted expanse from the waistband 47 to the leg bands 51 and 52 and the connecting crotch seam 48 between the fold lines 43 and 44. Apart from the fly assembly 41, the brief shown in FIG. 5 is of a conventional tubular knit construction.

Figure 3:
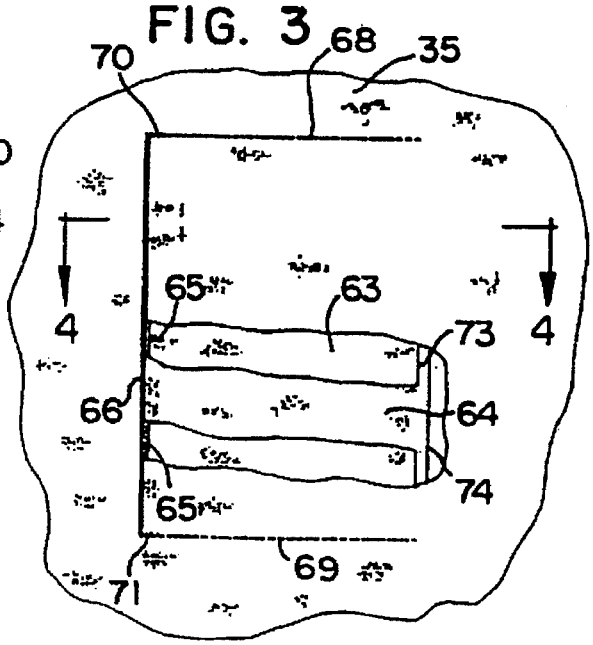
FIG. 3 is an enlarged fragmentary face view with layers broken away to illustrate the fly assembly shown in FIG. 1.
Figure 4:
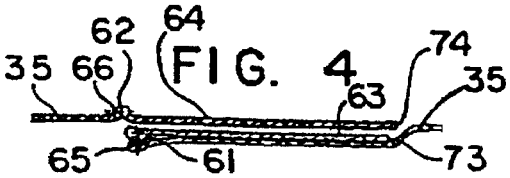
FIG. 4 is a sectional view taken on the line 4—4 of FIG. 3.

The novel fly assembly of the present invention is best illustrated in FIGS. 3 and 4. As shown in these figures, the front panel 35 has a linear fly opening formed between top and bottom ends by a pair of closely-spaced parallel fabric edges 61 and 62 (see FIG. 4). A pair of fly flaps 63 and 64 is included in the fly assembly 21. The flap 63 is connected to the fabric edge 61 by a seam 65 extending the entire length of the opening. The flap 64 is connected to the edge 62 by a similar seam 66 extending the entire length of the opening. The flaps 63 and 64 are coextensive in length with the fly opening and overlap each other and the front panel 35 of the fabric tube as shown in FIG. 4. In the illustrated embodiments, the flaps are disposed to the right of the opening defined between the edges 61 and 62. The flaps 63 and 64 form with the front panel 35 a triple layer of fabric which is sewn together by lines of stitching 68 and 69 along the top margin and bottom margin of the flaps 63 and 64, in the present instance extending generally perpendicular to the fly opening at the top and the ends. Where the lines of stitching 68 and 69 intersect the fly opening, double stitching is provided at 70 and 71, respectively, to provide reinforcement at the opposite ends of the fly opening. The lines of stitching 68 and 69 penetrate all three layers of the garment, and in the present instance are visible from the front of the garment, as indicated by the broken lines in FIGS. 1 and 5. The edges 73 and 74 of the flaps 63 and 64, respectively, are not sewn together and constitute free edges substantially parallel to the fly opening, as shown in FIGS. 3 and 4. In the present instance, neither is the free edge 73 sewn to the front panel 35. The free edges 73 and 74 may be readily separated to provide access to a tunnel-like passage between the flaps 63 and 64 which, as shown in FIG. 4, is laterally open to the interior of the garment at the righthand side and is open to the fly opening at the lefthand side. The tunnel provided between the flaps 63 and 64 serves to prevent bulging of the fly opening while permitting access through the garment.

Between the flap 63 and the front panel 35, a pocket is formed which is closed at the fly opening by the seam 65 and is closed at the top and bottom by the lines of stitching 68 and 69, and in the illustrated garment is open to the interior of the garment between the free edge 73 and the front panel 35.

Preferably, the flaps are of equal width and the width is at least one half of their length so as to provide an elongated tunnel extending the full width of the flap which requires access to be achieved laterally of the opening throughout the length of the tunnel. For example, in FIG. 1, the flap is about five inches long and about three inches wide. In FIG. 5, the flap is about five inches long is about 2½" wide. The dimensions of the flap enable the user to insert his hand through the tunnel to obtain access through the garment. The width of the tunnel is sufficient to provide support for the fabric edges 61 and 62 to prevent their inadvertent separation when the garment is worn.

The fly assembly of the present invention may be fabricated efficiently and effectively with a minimum number of handling operations. The steps for fabricating the assembly are illustrated in FIGS. 6–11.

Figure 6:
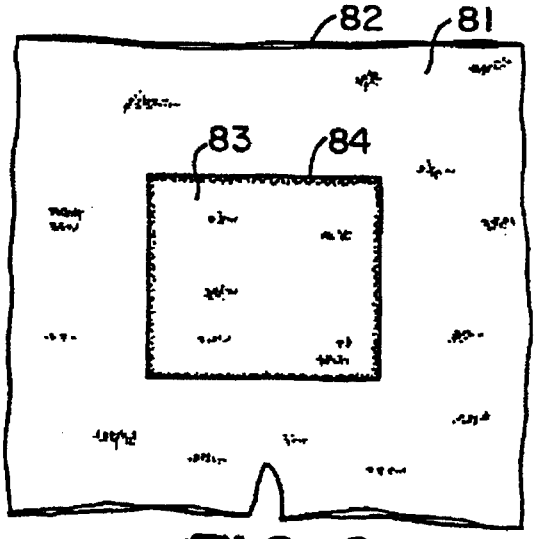
FIGS. 6–11 are views similar to FIG. 3 but at a reduced scale illustrating the steps for fabricating the fly assembly of the present invention.

FIG. 6 is a fragmentary view of a knitted tube which is designed to be formed into a body garment. As shown, the tube has a front panel 81 and a rear panel 82 created by flattening the tube. The top of the tube is open to constitute the waist of the garment, and the bottom of the tube, as shown in FIG. 6, is shaped to provide leg openings and a crotch. Referring to FIG. 6, the first step in the fabrication of the fly assembly is to overlay a fabric patch 83 over the area where the fly assembly is to be fabricated. To facilitate handling of the components during the assembly operation, the patch 83 is preferably finished around the edges as indicated at 84 to avoid raveling of the fabric during the fabrication operations. In the present instance, the perimeter of the patch 83 has overcast stitches to perform this function, but other means of providing a non-raveling edge around the perimeter of the patch may be substituted.

Figure 7:
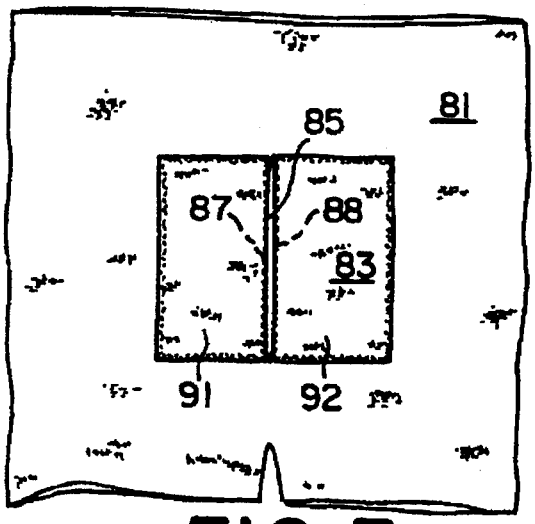

With the patch 83 in place, a fly opening 85 is cut through the patch 83 and the front panel 81, and the parallel edges provided on the opposite sides of the cut are sewn together by seams shown by the broken lines at 87 and 88 in FIG. 7. The cutting of the patch 83 divides the patch into a first flap 91 to the left of the opening 85 and a second flap 92 to the right of the opening 85 (FIG. 7). The cutting and seaming of the flaps 91 and 92 to the panel 81 may be performed simultaneously by a double-needle sewing machine with a cutting attachment or may be done in quick sequence by applying the double seam and then cutting between the seam lines. This attaches the flaps 91 and 92 to the fabric panel 81 by the seam lines 87 and 88, respectively.

Figure 8:
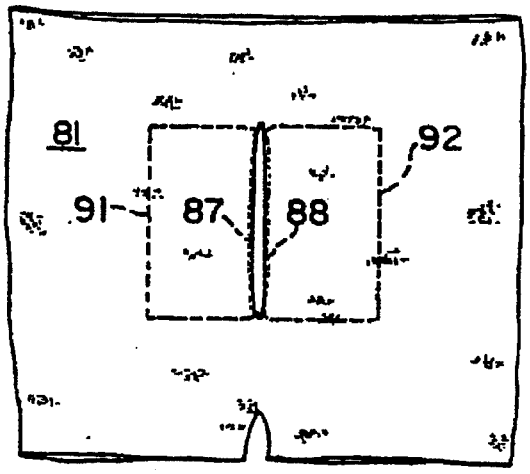
Figure 9:
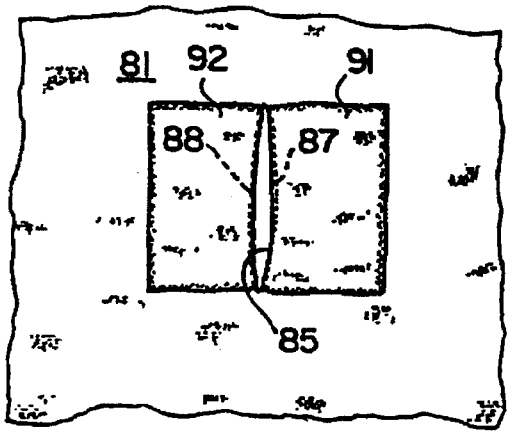
Figure 10:
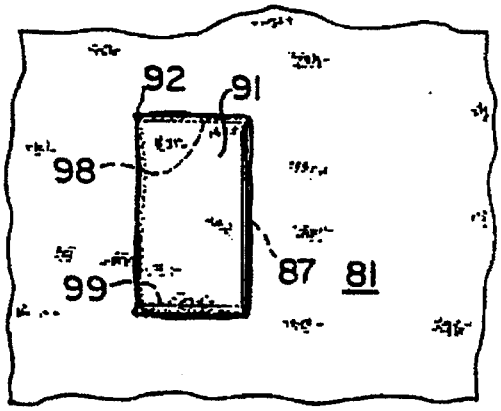
Figure 11:
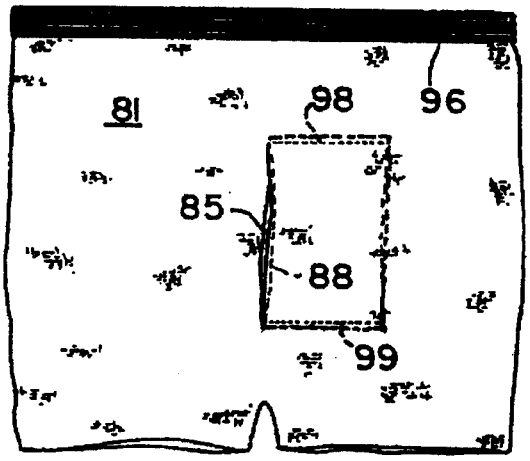

After the flaps are attached on the front of the garment, the flaps 91 and 92 are everted through the fly opening 85 to position them on the underside of the panel 81, as shown in FIG. 8. FIG. 9 illustrates the underside of the panel with the flaps spread apart on either side of the fly opening 85. The flap 91 is then folded over the flap 92, as shown in FIG. 10, so as to create a triple fabric thickness on the inside of the panel 81 to the left of the fly opening 85 (hidden behind the seam line 87 in FIG. 10). The triple layers are integrated by lines of stitching 98 and 99 at the top and bottom of the overlaid flaps. As shown in the view of the front of the panel 81 in FIG. 11, the seam lines 98 and 99 extend along the flaps and from the top and bottom of the fly opening 85 perpendicular to the opening to produce the tunnel and pocket as described above. Following this operation, the waistband 96 is applied to the top of the fabric tube and the legs are completed by the application of bands around the leg opening and a inseam and crotch seam interconnecting the front and back panels of the flattened tube. The completed garment may then be finished in the conventional fashion and packaged.

Thus, the fly assembly of this invention may be fashioned by a combined operation which cuts the fly opening and produces a pair of seams, followed by everting of the flaps through the fly opening and then anchoring the flaps to the panel by lines of stitching passing through the triple layers provided in this assembly. The fly fashioned in this manner is fully effective to provide the necessary access through the front of the garment and provides a pleasing ornamental appearance which will not impair the merchandising of the product.

While particular embodiments of the invention have been herein illustrated and described, it is not intended to limit the invention to such disclosure, but changes and modifications may be made therein and thereto within the scope of the following claims.

We claim:

1. In a nether garment having an interior and comprising a knitted tube with a front panel and a rear panel, said tube having a top waist opening and a pair of bottom leg openings, said leg openings being defined by a seam connecting the front and rear panels and extending from an inner side of one of said pair of leg openings across a central part of the knitted tube between said leg openings and terminating at an inner side of the other of said leg openings, a fly assembly in said front panel between said seam and the waist opening comprising a linear fly opening having a top end and a bottom end, and a length defined by a pair of closely-spaced parallel fabric edges formed by a cut in said tube, and a pair of fabric fly flaps, each flap being sewn to said fabric tube along an associated one of said fabric edges by a seam extending the entire length of said opening, said flaps having top margins and bottom margins and being coextensive in length with said fly opening and overlapping each other and the fabric tube at one side of the fly opening, the top margins of both flaps being adjacent the top end of said fly opening and the bottom margins of both flaps being adjacent the bottom end of said fly opening, thereby providing a triple layer of fabric along the full length of the fly opening at one side thereof, said triple layer being united by two lines of stitching respectively extending through both of said flaps and said fabric tube along the top margins and bottom margins of said flaps, leaving a free edge on each flap extending parallel to said fabric edges remote from said fly opening between said lines of stitching, a first one of said flaps being positioned on the interior of the garment, a second one of said flaps being positioned intermediate the first flap and the knitted tube, said first and second flaps defining between them a transversely open tunnel extending from said fly opening to the free edges of said flaps, and the second flap and said tubular fabric defining between them a pocket closed at one end by the seam sewing said second flap to the associated fabric edge of said fly opening.

2. A fly assembly according to claim 1 wherein each of said seams along the length of said fly opening has a thread line providing a stitched flap margin parallel to said free flap edge, said flap margin overlying said fabric edge at one side of said thread line, the fabric margin of said first flap projecting toward the interior of said garment, and the fabric margin of said second flap being confined within said pocket at said one end.

3. A fly assembly according to claim 1 wherein said lines of stitching along the top and bottom margins of the flaps terminate at the top and bottom ends of the fly opening in a short length of double stitching crossing the fly opening to reinforce the same.

4. A fly assembly according to claim 1 wherein said seams terminate at the top and bottom ends of said fly opening and said two lines of stitching terminate at the edges of said flaps, said pocket being open along the free edge of said second flap whereby the front panel of said knitted tube which circumscribes said fly opening is devoid of stitching except for said two lines of stitching, and consists of a single layer of tubular knit fabric surrounding said fly assembly.

5. A nether garment having an interior and comprising a knitted tube flattened to provide fold lines at opposite sides of the garment, said fold lines defining a front panel and a rear panel, said front and rear panels being integrally united at said fold lines as parts of a single piece of knitted tubular fabric, said tube having a top waist opening and a pair of bottom leg openings, each of said openings having a band circumscribing said opening, said leg openings being defined by a seam connecting the front and rear panels and extending from an inner side of one of said pair of leg openings across central parts of the knitted tube and terminating at an inner side of the other of said leg openings, a fly assembly in said front panel between said seam and the waist opening comprising a linear fly opening having a length from a top end to a bottom end defined by a pair of closely-spaced parallel fabric edges formed by a cut in said front panel, and a pair of fabric fly flaps, each flap being sewn to said front panel along an associated one of said fabric edges by a seam extending the entire length of said opening, said flaps being coextensive in length with said fly opening and overlapping each other and the front panel at one side of the fly opening, top margins of both flaps being adjacent the top end of said fly opening and bottom margins of both flaps being adjacent the bottom end of said fly opening, thereby providing a triple layer of fabric along the full length of the fly opening at one side thereof, said triple layer being sewn together by two lines of stitching respectively extending through both of said flaps and said front panel along the top and bottom margins of said flaps, leaving a free edge on each flap remote from said fly opening and extending parallel to said fabric edges between said lines of stitching, a first one of said flaps being positioned on the interior of the garment, a second one of said flaps being positioned intermediate the first flap and the front panel, said first and second flaps defining between them a transversely open tunnel extending from said fly opening to the free edges of said flaps, and the second flap and said front panel defining between them a pocket closed at one end by the seam sewing said second flap to the associated fabric edge of said fly opening.

6. A nether garment according to claim 5 consisting essentially of said knitted tube, said bands at the waist and the legs, and said fabric flaps joined to said tube by said seams and said lines of stitching, whereby said rear panel is an uninterrupted expanse of knitted fabric from the band at the waist to the bands at the leg openings and the seam therebetween, and the front panel is similarly an expanse of knitted fabric which is uninterrupted except for said fly assembly.

7. A garment according to claim 5 wherein the band at the top opening of the tubular fabric consists of a waist band of resilient stretchable fabric having a length beginning at a point along the top opening of the fabric tube and extending continuously around the top opening and terminating adjacent said beginning.

8. A garment according to claim 5 in the form of a brief having a crotch, the front and back panels being of generally uniform length, wherein said connecting seam extends parallel to the waist band for a short distance between said leg openings in said crotch.

9. A garment according to claim 5 in the form of drawers having a crotch, said front and back panels having leg extensions from said crotch along opposite fold lines and terminating in said leg openings, wherein said connecting seam has a central part generally parallel to the waist band extending as a crotch seam for a short distance between said leg extensions, and end parts extending as inseams generally parallel to said fold lines along said leg extensions from said central part to said leg openings.

10. A garment according to claim 9 wherein the leg opening bands comprise stretchable fabric, and form cuffs at the lower ends of said leg extensions.

11. A garment according to claim 5 wherein said flaps have a width between said fabric edge and said free edge which is at least forty percent of the length of said flaps between said two lines of stitching.

12. A method of making a fly assembly in a nether garment having an interior and comprising a knitted tube with a front panel and a rear panel, said tube having a top waist opening and a pair of bottom leg openings, said leg openings being defined by a seam connecting the front and rear panels and extending from an inner side of one of said pair of leg openings across central parts of the knitted tube and terminating at an inner side of the other of said leg openings, comprising the steps of:

cutting the front panel of the tube to produce a pair of closely-spaced parallel fabric edges defining between them a fly opening of a given length;

providing a pair of fabric fly flaps, each having a marginal edge of a length corresponding to said given length, associating each of said marginal edges with a separate one of said parallel fabric edges, and positioning said flaps overlying one fabric surface of the front panel of the tube outwardly from said fly opening;

sewing together said associated marginal and fabric edges respectively with separate seams running the length of said fly opening;

everting said flaps through said fly opening to position said flaps at an opposite fabric surface of the front panel, with both flaps extending in the same direction over said opposite surface along the fly opening, thereby forming a triple layer comprising a first of said flaps in an interior side of the garment, said front panel of the tube on an exterior side of the garment, and a second of said flaps between said first flap and said front panel;

uniting said triple layer by lines of stitching along said flaps at opposite ends of said marginal edges, leaving a free edge on each flap extending generally parallel to said marginal edge remote from said fly opening between said lines of stitching;

said first and second flaps defining between them a transversely open tunnel extending from said fly opening at one side to the free edges of said flaps at the other side, and the second flap and said tubular fabric defining between them a pocket closed at one side by the seam sewing said second flap to the associated fabric edge of said fly opening.

13. A method according to claim 12 wherein said flaps are provided by overlaying a fabric patch over the front panel prior to cutting said fly opening, and cutting said patch to form two flaps when performing the cutting of the fly opening.

14. A method according to claim 13 wherein said sewing step is performed concurrently with cutting said patch and said fly opening.

15. A method according to claim 14 wherein said sewing step produces seams separating said fabric edges and flap margins from the bodies of said flaps, whereby after everting said flaps, the seam of the first flap is on the interior of said garment and the seam of the second flap is within the pocket defined between the second flap and the tubular fabric.

16. A method according to claim 13 wherein said patch is rectangular and said cut is parallel to opposite sides of said patch, including the step of finishing the perimeter of the patch to retard raveling prior to cutting the patch.

17. A method according to claim 12 wherein said step of uniting said layers includes a final operation of applying short lengths of double stitching in the lines of stitching at opposite ends of said fly opening to reinforce the same.

18. A nether garment having a top waist opening and a pair of bottom leg openings, a front panel of fabric extending from the waist opening to the leg openings, and a fly assembly in said front panel comprising:

a linear fly opening having a length defined by a pair of closely-spaced parallel fabric edges in said panel;

a pair of generally rectangular fabric fly flaps, each flap being sewn to said panel along an associated one of said fabric edges by a seam extending the entire length of said opening;

said flaps being coextensive in length with said fly opening and having a width at least forty percent of their length and overlapping each other and the front panel at one side of the fly opening, both flaps having top margins adjacent the top of said fly opening and bottom margins adjacent the bottom of said fly opening, thereby providing a triple layer of fabric along the full length of the fly opening at one side thereof;

said triple layer being united by two lines of stitching respectively extending through both of said flaps and said front panel along the top and bottom margins of said flaps, leaving a free edge on each flap extending parallel to said fabric edges remote from said fly opening between said lines of stitching, a first one of said flaps being positioned interiorly of the garment, a second one of said flaps being positioned intermediate the first flap and the front panel;

said first and second flaps defining between them a transversely open tunnel extending the full width of said flaps from said fly opening to the free edges of said flaps; and the second flap and said front panel defining between them a pocket closed at one end by the seam sewing said second flap to the associated fabric edge of said fly opening.

19. A garment according to claim 18 wherein said front panel extends as a single piece of fabric from said waist opening to said leg openings and having a substantially straight cut of a length corresponding to the distance between said top and bottom lines of stitching, said fabric edges being on opposite sides of said cut.

20. A garment according to claim 19 wherein said two lines of stitching terminate at the free edges of said flaps, said pocket being open interiorly of said garment along the free edge of said intermediate flap.

* * * * *

UNITED STATES PATENT AND TRADEMARK OFFICE

CERTIFICATE OF CORRECTION

PATENT NO. : 5,630,232

DATED May 20, 1997

INVENTOR Robert A Miller, George Banavage

It is certified that errors appear in the above-identified patent and that said Letters Patent is hereby corrected as shown below Column 3, line 32, "top margin and bottom margin" should be --top margins and bottom margins--, line 34, "ends" should be --bottom ends--

Signed and Sealed this

Third Day of February, 1998

*Attest:*

BRUCE LEHMAN

*Attesting Officer*

*Commissioner of Patents and Trademarks*